United States Patent [19]

Marcroft

[11] 4,424,892

[45] Jan. 10, 1984

[54] COIN OPERATED NEWSRACK

[75] Inventor: Brian J. Marcroft, Norwalk, Calif.

[73] Assignee: The Times Mirror Company, Los Angeles, Calif.

[21] Appl. No.: 332,668

[22] Filed: Dec. 21, 1981

Related U.S. Application Data

[63] Continuation-in-part of Ser. No. 168,007, Jul. 14, 1980, abandoned, which is a continuation-in-part of Ser. No. 113,576, Jan. 21, 1980, abandoned.

[51] Int. Cl.[3] ..... G07F 9/04

[52] U.S. Cl. ..... 194/1 D; 194/97 R

[58] Field of Search ..... 194/1 C, 1 D, 51, 59, 194/65, 1 G, DIG. 15, 54, DIG. 2, 97 R, DIG. 28, DIG. 29, DIG. 30

[56] References Cited

U.S. PATENT DOCUMENTS

| | | | |
|---|---|---|---|
| 1,912,160 | 5/1933 | Richardson et al. | 194/1 D |
| 3,940,136 | 2/1976 | Runte | 194/1 B X |
| 4,175,989 | 11/1979 | Pospischil et al. | 194/1 C |

*Primary Examiner*—Stanley H. Tollberg
*Attorney, Agent, or Firm*—Christie, Parker & Hale

[57] ABSTRACT

A coin mechanism (42) is located above a coin collecting chamber (28) in a coin mechanism housing (22). A partition (46) in the housing separates the coil collecting chamber from the coin mechanism. An opening (54) permits coins to drop from the coin mechanism to the coin collecting chamber. The housing has a removable hood (36) exposing the coin mechanism without exposing the coin collecting chamber. A control device (62) is movable between a first position and a second position. A plate (68) connected to the control device covers the passageway to divert coins from the coin mechanism to a return receptacle (30) when the control device is in its first position. The plate clears the passageway to transfer coins from the coin mechanism to the coin collecting chamber when the control device is in its second position. A baffle system directs coins from the coin mechanism to the center of the collecting chamber. The housing is mounted on a frame having a substantially flat top panel under the top panel to form between the top panel and the top of the housing a hood receiving region having an entrance. A restriction is formed at the entrance of the region between the top panel and the housing to permit passage of the top of the hood into the region only when acutely angled relative to the housing. The hood fits the housing in parallel abutting relationship so as to with the housing completely enclose the coin mechanism.

21 Claims, 20 Drawing Figures

Fig. 12
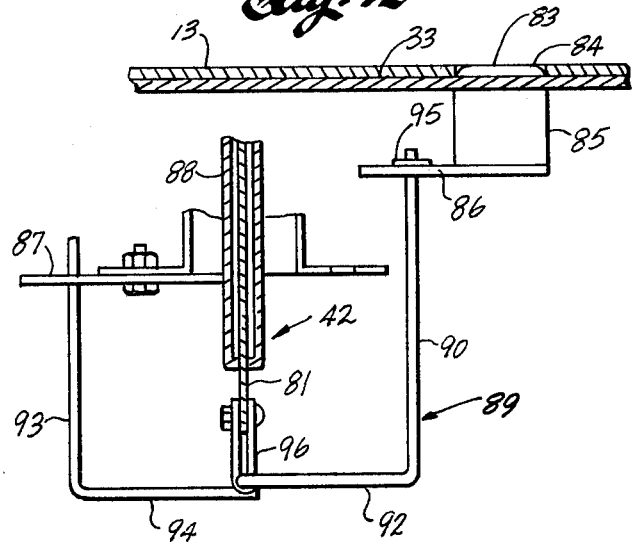
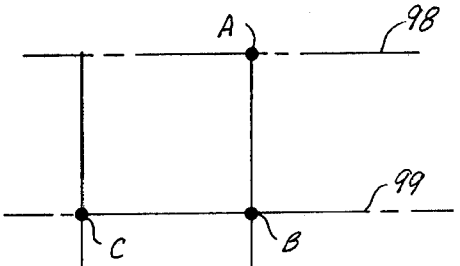
Fig. 13A
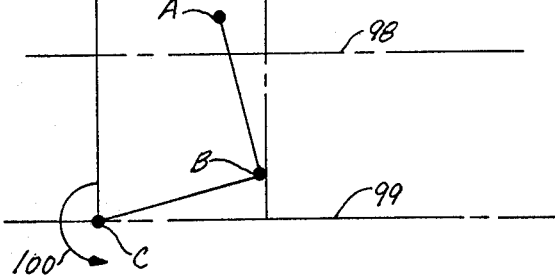
Fig. 13B

COIN OPERATED NEWSRACK

CROSS REFERENCE TO RELATED APPLICATIONS

This application is a continuation-in-part of application Ser. No. 168,007 filed July 14, 1980, which is a continuation-in-part of Ser. No. 113,576 filed Jan. 21, 1980. Both of these prior applications are now abandoned.

BACKGROUND OF THE INVENTION

This invention relates to coin operated product dispensing equipment and, more particularly, to an improved coin operated newsrack.

Coin operated newsracks are generally situated at street corners and public places and are therefore the object of attention of vandals and pilferers and even dishonest employees servicing the newsracks. With this fact of life in mind, it is necessary to design newsracks to provide effective security for the money and the newspapers stored therein and rugged construction to withstand the abuses encountered on the street.

One important requirement is to provide an enclosure for the coin mechanism and coin collecting chamber that will withstand jimmying. Chalabian U.S. Pat. No. 4,049,106 discloses a hood and a coin mechanism housing designed for this purpose.

Another newsrack design requirement is to provide what amounts to a one-way coin transfer path from the coin mechanism to the coin collecting chamber so that coins cannot be removed from the newsrack by turning it upside down or inserting a wire into the door latch opening. U.S. Pat. No. 4,049,106 discloses a baffle system for establishing such a one-way coin transfer path. This baffle system, however, empties into the coin collecting chamber along one side, thereby creating an uneven distribution of coins in the chamber.

U.S. Pat. No. 4,049,106 also discloses a linkage for changing the coin combination to which the coin mechanism responds by means of a cylinder lock. This linkage contains a loose connection in order to accommodate the eccentricity of the linkage relative to the rotational axis of the lock.

Coin operated newsracks are generally loaded with newspapers more frequently than the coin collecting intervals. More and different people perform the former function than the latter. To reduce pilferage, it is desirable to let the newspaper loaders gain access to the newspaper storage compartment of the newsrack without genuine coins or a key to the interior of the coin mechanism housing. To this end, it is common practice to provide the newspaper loaders with slugs to open the newspaper storage compartment of the newsrack for loading purposes. However, the slugs must be separated from the genuine coins after coin collection, an operation that might cost thousands of dollars a year at a newspaper having large newsrack circulation.

The coin mechanisms of newsracks occasionally jam, which requires a serviceman to clear the jammed coin mechanism. When the serviceman gains access to the interior of the housing for the coin mechanism to unjam it, the coin collecting chamber is exposed to pilfering.

SUMMARY OF THE INVENTION

According to one feature of the invention, a coin operated newsrack has a coin mechanism adapted to unlock the door of a newspaper storage compartment and drop coins at a designated deposit point in a coin mechanism housing responsive to an actuator when the proper coinage is present; the coin mechanism is adapted to drop coins at a designated return point in the housing responsive to the actuator when the proper coinage is not present. A passageway extends between the deposit point and a coin collecting chamber underneath the deposit point to permit coins to drop from the coin mechanism to the coin collecting chamber. A coin transfer path extends from the return point to a coin return receptacle in the housing. A control device, such as a cylinder lock, is movable between a first position and a second position. Responsive to the control device in its first position, coins at the deposit point are diverted from the passageway to the return receptacle and in its second position the passageway is cleared to transfer coins from the deposit point to the coin collecting chamber. Thus, to load newspapers into the storage compartment, the control device is initially placed in its first position by the worker responsible for loading. Then, the worker deposits the proper coinage in the coin mechanism and opens the door to load the newsrack, which transfers the deposited coinage to the return receptacle for reuse by the worker at the next newsrack that he loads. Finally, he returns the control device to its second position for use by customers.

Another feature of the invention is a baffle system in the passageway between the deposit point and the coin collecting chamber that distributes coins evenly for storage purposes in the coin collecting chamber. Specifically, a partition having an opening in the vicinity of the deposit point separates the coin collecting chamber from the coin mechanism. A first baffle is attached to the partition adjacent to one side of the opening and extends downwardly from the partition to deflect toward the other side of the opening coins dropping to the chamber. A second flat baffle is attached to the partition adjacent to the other side of the opening and extends downwardly from the partition toward the first baffle such that the baffles converge toward approximately the middle of the chamber. Preferably, the second baffle is pivoted by a hinge to open and close the opening responsive to a control device so as to implement the feature described in the preceding paragraph.

According to another feature of the invention, a coin operated newsrack has a coin mechanism mounted in a housing, a coin collecting chamber in the housing underneath the coin mechanism, and a partition in the housing separating the coin collecting chamber from the coin mechanism. The housing has a removable hood exposing the coin mechanism without exposing the coin collecting chamber. Thus, a serviceman can gain access to the coin mechanism by removing the cover, without being able to gain access to the coin collecting chamber.

Another feature of the invention is an enclosure for a coin mechanism. A housing has a plurality of substantially closed sides, a closed top, a closed bottom, and an open side between at lest part of the top and bottom and between two of the substantially closed sides. The housing is mounted under the flat top panel of a support frame to form between the top panel and the closed top of the housing a hood receiving region having an entrance. A hood for the housing has a plurality of substantially closed sides, an open top, an open bottom, and an open side between the top and bottom and between two of the substantially closed sides. A restriction is formed at the entrance between the top panel and the housing to permit passage of the top of the hood into the region only when acutely angled relative to the housing. The hood fits the housing in parallel abutting relationship; the top of the hood occupies the region when in place such that the substantially closed sides of the hood cover the open side of the housing. Brackets or other means secure the hood in place.

According to another feature of the invention, an integral linkage couples a crank mounted on a cylinder lock to the coin combination changing means of a coin mechanism. The integral linkage has a first section, a second section transverse to the first section in non-intersecting relationship therewith, and a third section connecting the first and second sections and being approximately transverse thereto. The second section is supported with freedom of axial and rotational movement. There is a connection between the crank and one end of the first section providing rotational and axially translational freedom of movement for the first section. As the lock rotates, the integral linkage translates up and down and rotates to change the coin combination to which the coin mechanism responds.

BRIEF DESCRIPTION OF THE DRAWINGS

The features of a specific embodiment of the best mode contemplated of carrying out the invention are illustrated in the drawings, in which:

FIG. 12 is a top sectional view of the newsrack housing showing the linkage in the coin changeover; and FIGS. 13A and 13B are diagrams illustrating the operation of the coin changeover linkage;

DETAILED DESCRIPTION OF THE SPECIFIC EMBODIMENT

Figure 1:
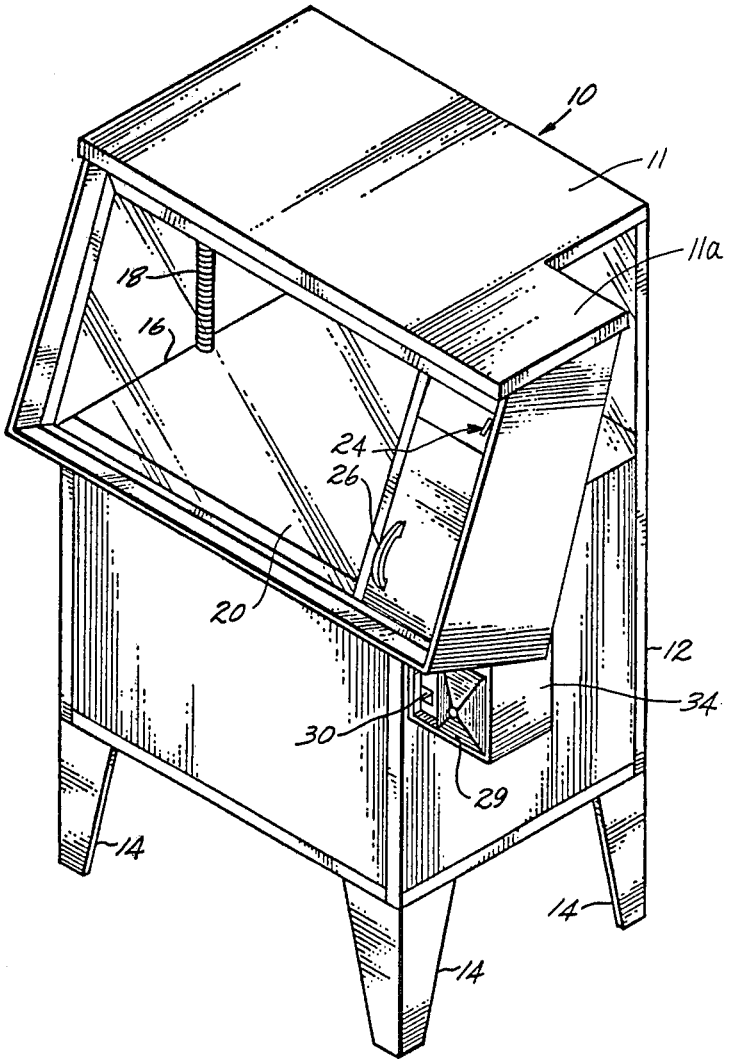
FIG. 1 is a perspective view of a coin operated newsrack incorporating the features of the invention.
Figure 2:
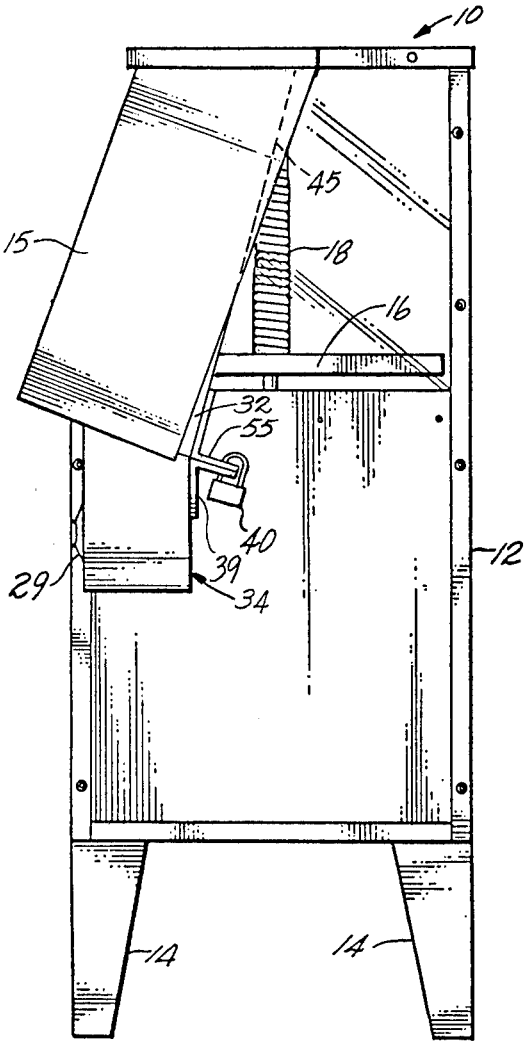
FIG. 2 is a side elevation view of the newsrack.
Figure 3:
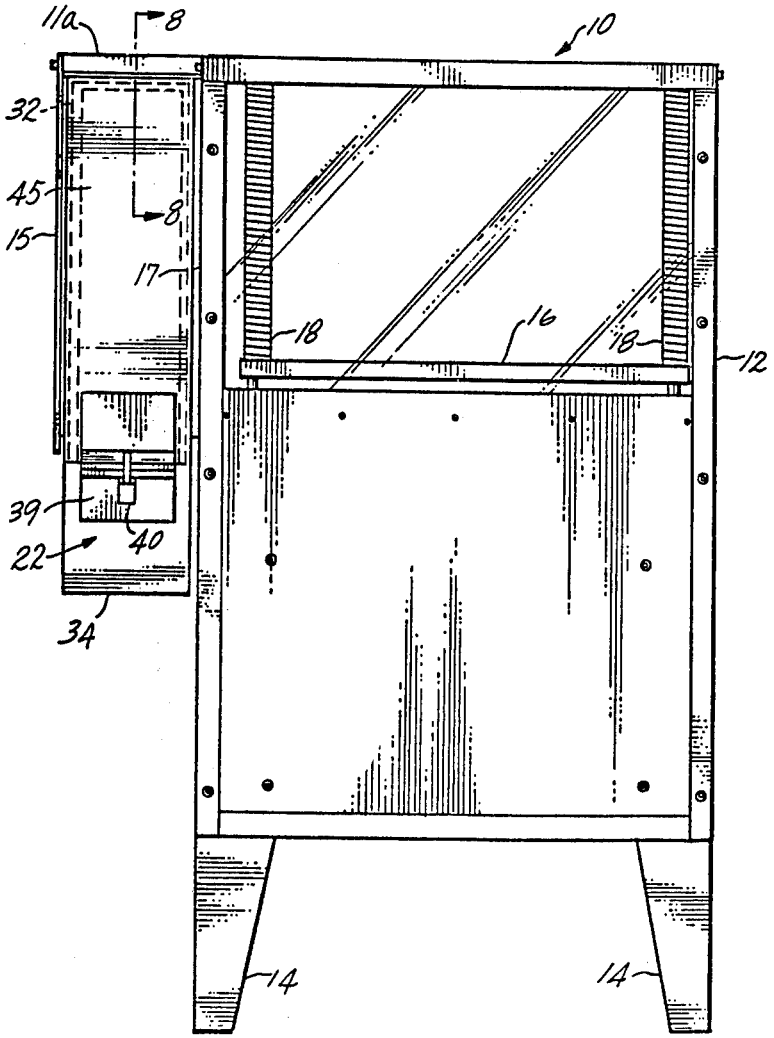
FIG. 3 is a back elevation view of the newsrack.

In FIGS. 1, 2, and 3 a newsrack 10 is shown. For a more detailed disclosure of newsrack 10, reference is made to the co-pending design patent application of John A. Salario and Brian Marcroft, Ser. No. 113,571 filed on Jan. 21, 1980, the disclosure of which is incorporated fully herein by reference. Newsrack 10 comprises a hollow generally rectangular frame 12 supported by legs 14 that rest on the floor or ground. Frame 12 has a flat horizontal top panel 11 that is basically rectangular in shape, but has a small rectangular extension 11*a* at one corner, namely, the front right-hand corner as viewed in FIG. 1. A horizontal platform 16 inside frame 12 is attached to top panel 11 by springs 18. Vertical guide rods not shown run through springs 18 from top to bottom of frame 12 to keep platform 16 horizontal. The interior of frame 12 above platform 16 defines a newspaper storage compartment to which access can be gained by a normally locked door 20 at the front of newsrack 10. Door 20 has horizontally oriented hinges 23 (FIG. 8) which attach it to frame 12, and a handle 26. A coin mechanism housing 22 is attached to the right side of frame 12 directly behind door 20 and under extension 11*a*. A coin receiving slot 24 in door 20 leads to a coin mechanism of conventional construction in housing 22, such as the coin mechanism described in Chalabian U.S. Pat. No. 3,884,330 issued May 20, 1975, the disclosure of which is incorporated fully herein by reference. When a customer inserts the proper coinage in slot 24 and pulls on handle 26, which serves as an actuator, door 20 is unlocked and thus can be opened by lifting upwardly on handle 26. When newspapers are loaded on platform 16, it drops toward the bottom of frame 12 due to the newspaper weight. As newspapers are subsequently removed by customers and the weight becomes less, springs 18 draw platform 16 upwardly so that the top of the pile of newspapers remains at the level of door 20. The inserted coins are transferred from the coin mechanism to a coin collecting chamber with a lockable door 29. When a customer inserts improper coinage in slot 24 and pulls on handle 26, the coin mechanism delivers the coins to a return receptacle 30 without unlocking door 20.

Figure 8A:
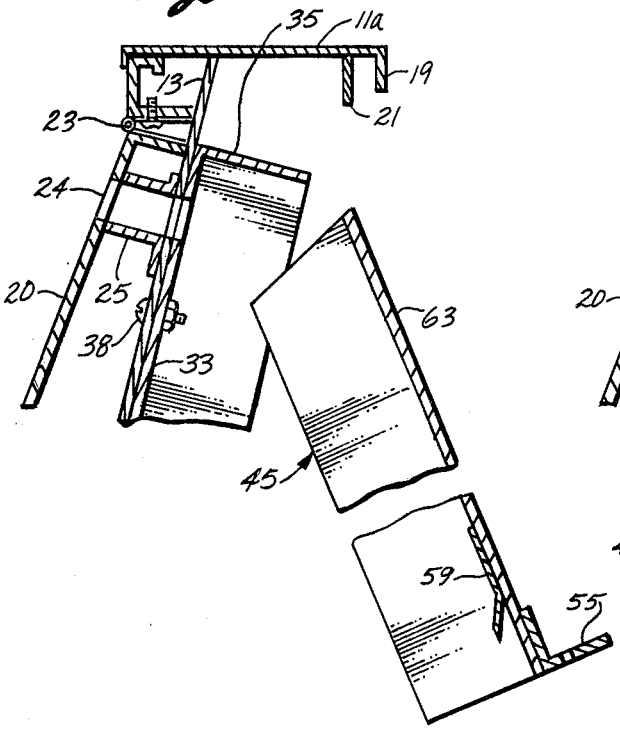
FIGS. 8A and 8B are side sectional views of a portion of the newsrack taken through the plane designated in FIG. 3, depicting the hood during installation and in place, respectively.
Figure 8B:
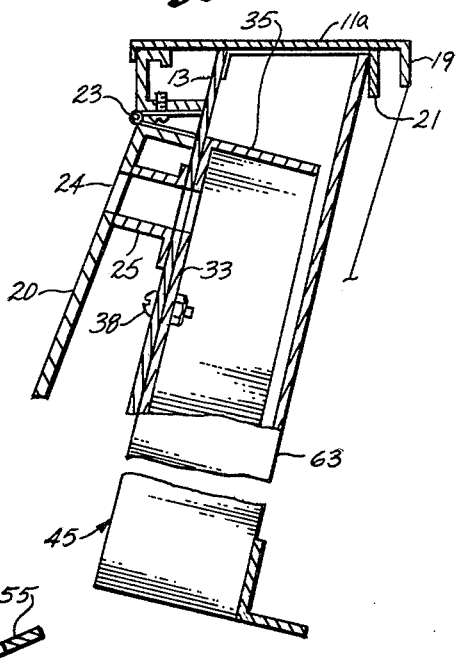
Figure 9:
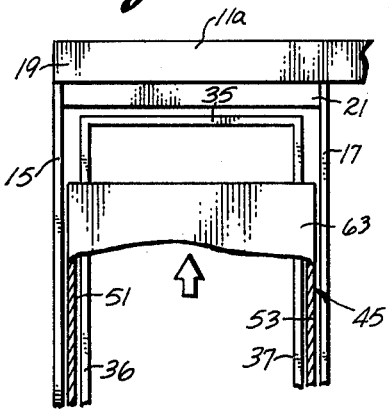
FIG. 9 is a back partially cut away view of a portion of the newsrack, depicting the hood during installation.

As shown in FIGS. 8A, 8B, and 9 behind the portion of door 20 on which coin receiving slot 24 and handle 26 are located frame 12 has a slanted front panel 13. Vertical flank panels 15 and 17 extend rearwardly from front panel 13 to form therewith under top panel extension 11*a* an enclosure that is closed on three sides and open on the fourth side, namely, the back. Beacuse of the slant of front panel 13, it forms a first given obtuse angle, e.g., about 100°, with top panel 11, including extension 11*a*. Along its back edge, extension 11*a* has a downwardly extending vertical lip 19. A bar 21 is secured by welding or the like to the underside of extension 11*a* so as to extend vertically downward in parallel relationship with lip 19.

Housing 22 comprises in an integral construction an upper portion 32 with an open back and a lower portion 34 with a closed back. Upper portion 32 has a front panel 33, a top panel 35, and flank panels 36 and 37. Front panel 33 is secured to front panel 13 by bolts 38 or other suitable fasteners. Top panel 35 is approximately perpendicular to panels 33, 36, and 37. The coin mechanism is mounted in upper portion 32 as for example by bolting to front panel 33. A coin transfer chute 25 mounted on the front of panel 13 carries coins from coin receiving slot 24 to the coin mechanism via openings in panels 13 and 33. (If the coin mechanism has two coin transfer chutes, as shown in U.S. Pat. No. 3,884,330, there would be two slots 24 and two chutes 25.)

Lower portion 34 is completely closed except for a recess 28 opening toward the front thereof that defines the coin collecting chamber and an open top that is protected from human intrusion by a baffle system described below. Coin return receptacle 30 opens toward the front of lower portion 34. An L-shaped bracket 39, which is mounted on the back of lower portion 34 has a portion with a locking hole extending away from housing 22. As illustrated in FIG. 5, the back of portion 32 forms with the back of portion 34 a second given obtuse angle, e.g., 170°, such that the sum of the first and second obtuse angles is approximately 270°. When housing 22 is in place, lower portion 34 extends below frame 12 and its rear panel is approximately vertical because of the angle between portions 32 and 34. Since lower portion 34 is unprotected by frame 12, it has thicker flank panels than upper portion 32. As a result, shoulders 41 and 43 (FIG. 4) are formed where the flank panels of portions 32 and 34 meet.

Figure 10:
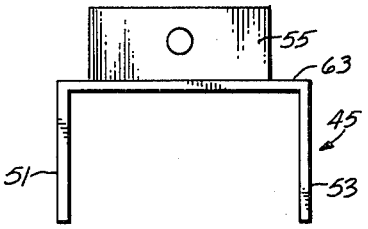
FIG. 10 is a bottom plan view of the hood.

When in place, a hood 45 covers the open back of upper housing portion 32. Hood 45 has a back panel 63, flank panels 51 and 53 approximately perpendicular to back panel 63, and an open front to form a generally U-shaped cross section, as illustrated in FIG. 10. Hood 45 further has an open bottom that is approximately perpendicular to panels 63, 51, and 53 and an open top that forms approximately the first given obtuse angle with the open front thereof, e.g., 110°. A bracket 55, which is secured to the bottom of back panel 49 has a portion extending away from hood 45 with a locking hole. A deflecting plate 59 is fixed to the interior surface of back panel 49. A portion of plate 59 is flush with panel 49 and another portion of plate 59 extends downwardly at an acute angle to panel 49 so as to deflect to return receptacle 30 coins that fall when the coin chutes of the coin mechanism open.

As illustrated in FIG. 9, flank panels 15 and 36 and flank panels 17 and 37 form longitudinal channels into which flank panels 51 and 53 of hood 45 fit during installation of hood 45 and when it is in place. Bar 21 and the rear edge of top panel 35 together form a restriction at the entrance of the region between extension 11*a* of frame 12 and top panel 35 of housing 22. As illustrated in FIG. 8A, these elements are so dimensioned as to permit passage of the top edge of hood 45 into this region only when acutely angled relative to housing 22.

To install hood 45, the top of back panel 63 is first inserted into the restriction and the top of flank panels 51 and 53 are fitted into the channels with hood 45 acutely angled as illustrated in FIGS. 8A and 9. Then, the bottom of hood 45 is pivoted about the top thereof, which is in the region between extension 11*a* and top panel 35, to bring hood 45 into place against housing 22. During installation of hood 45, the bottom edges of flank panels 51 and 53 are guided and supported by shoulders 41 and 43, respectively, and in some cases by bracket 39, which may bear against bracket 55. When hood 45 is in place, it covers the open back of housing 22, the edges of panels 35, 36, and 37 abut back panel 63, the bottom edges of flank panels 51 and 53 rest on shoulders 41 and 43, respectively, and the top of hood 45 is approximately parallel to top panel 11, as shown in FIG. 8B. To secure hood 45 in place, brackets 39 and 55 are shackled by a padlock 40. Bar 21 and lip 19 protect the top of hood 45 from intrusion, for example by jimmying. Flank panels 15 and 17 protect the flanks of hood 45 from intrusion, for example by jimmying. The obtuse angle formed at the top of hood 45 prevents its pivoting about the bottom thereof when brackets 39 and 55 are shackled; this provides added protection to hood 45 against jimmying if for example, a crowbar manages to penetrate lip 19 and bar 21. Three panels protect each flank of the coin mechanism against intrusion, namely, panels 15 and 17, panels 51 and 53, and panels 36 and 37. Thus, the described construction provides for the coin mechanism a secure enclosure that effectively resists jimmying and other attempts at intrusion.

Figure 4:
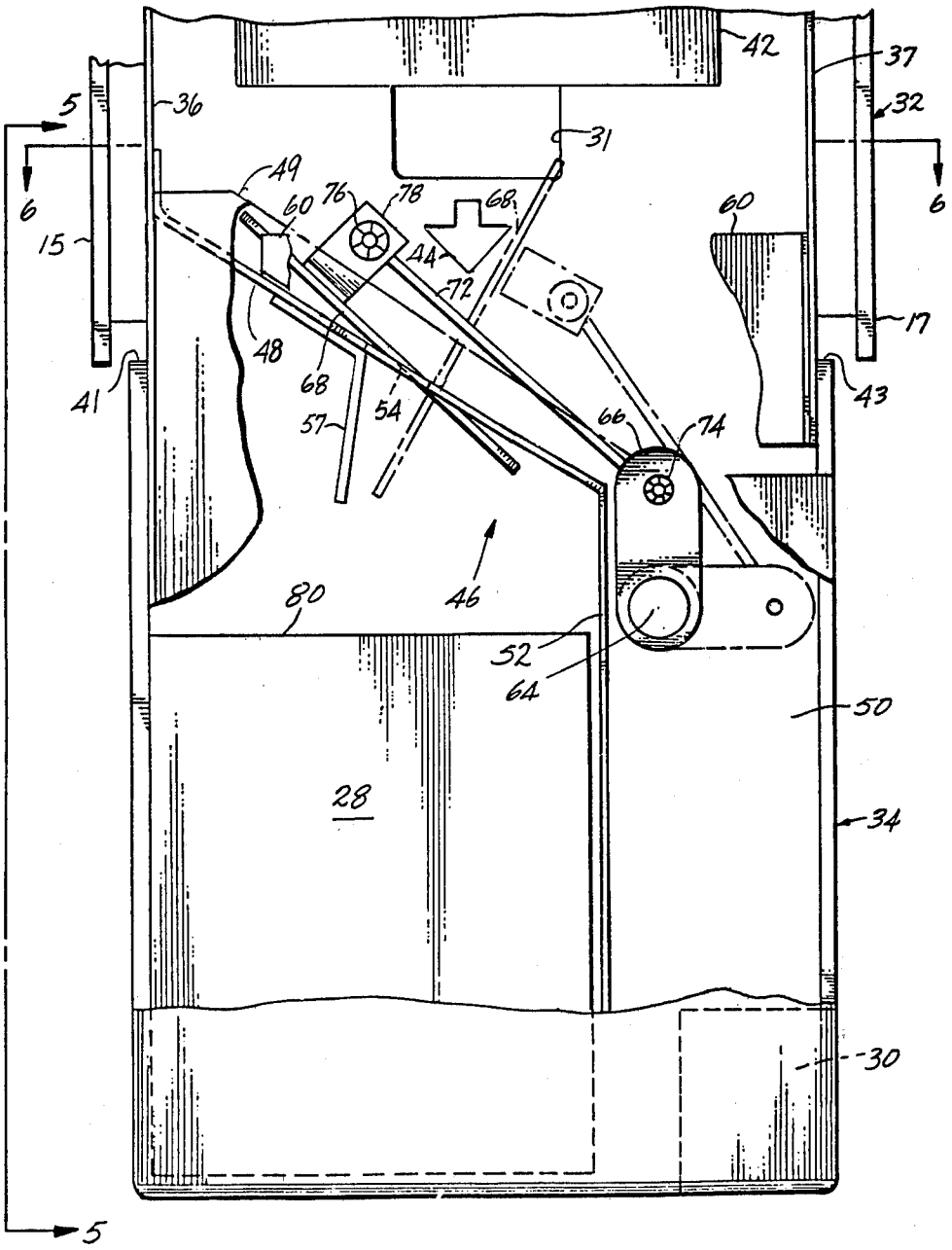
FIG. 4 is a partially cut away back view of the lower portion of the coin mechanism housing of the newsrack of FIG. 1 without the hood.
Figure 5:
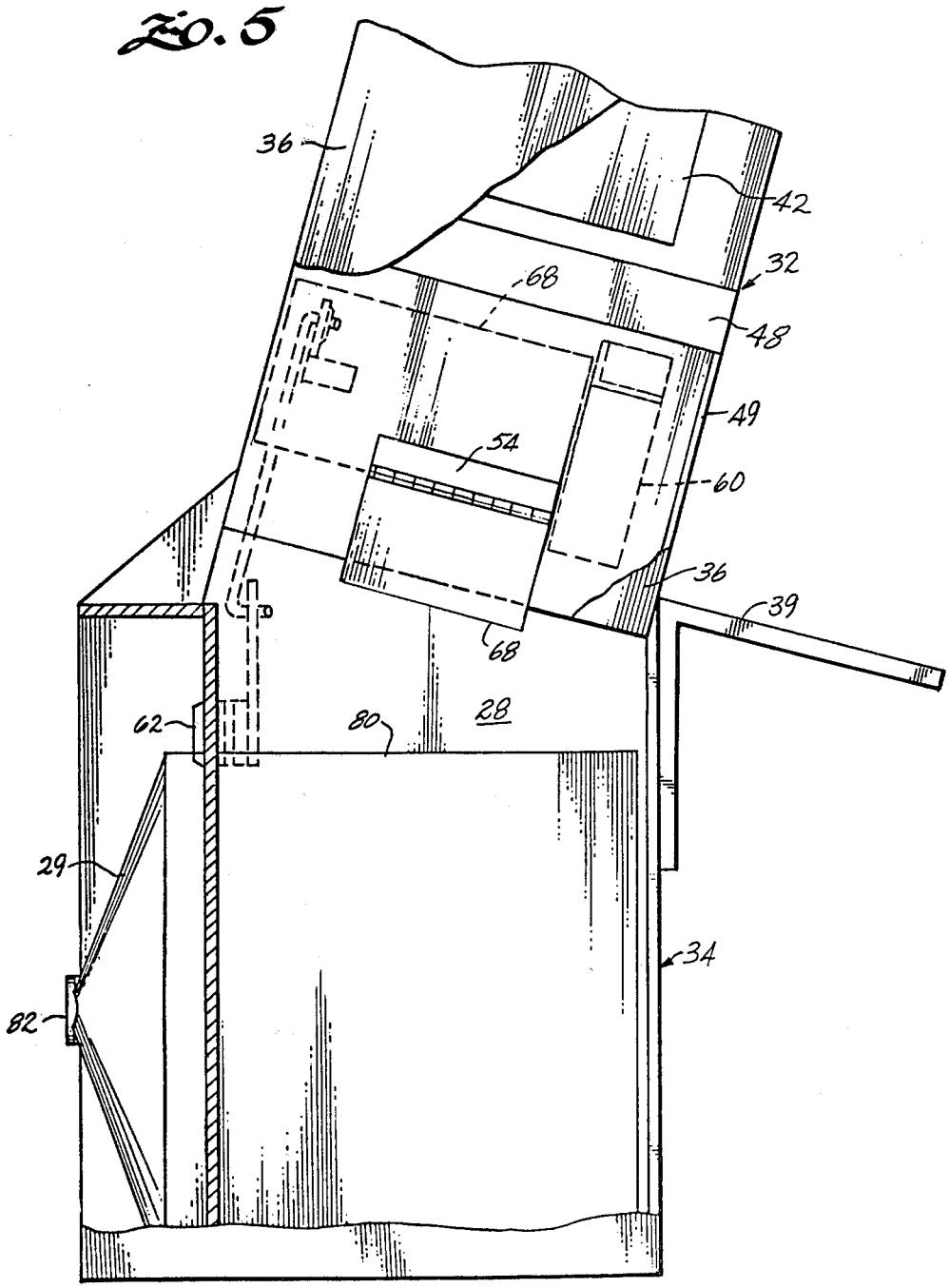
FIG. 5 is a partially cut away right side view of the lower portion of the coin mechanism housing.
Figure 6:
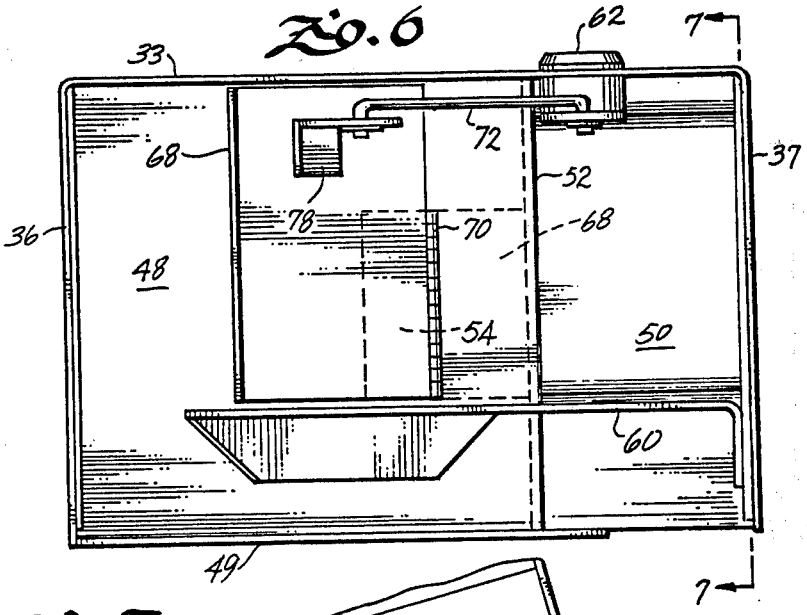
FIG. 6 is a top sectional view of the coin mechanism housing taken through the plane designated in FIG. 4.

In FIGS. 4 through 7, the interior structure of housing 22 is shown with hood 45 removed. The coin mechanism is represented schematically and designated 42. As handle 26 is pulled with the proper coinage in coin mechanism 42, the coins are dropped thereby to a designated deposit point as represented by an arrow 44. An opening 31 is formed in front panels 33 and 13 through which the door latch (not shown) protrudes to a position under coin mechanism 42. See application Ser. No. 168,017, filed on July 14, 1980, by Bradley Maxwell, for a description of a preferred form of the door latch and its location relative to the remainder of the newsrack; the disclosure of that application is incorporated fully herein by reference. The baffle system protecting the top of portion 34 comprises a partition 46, a deflector 57, and a gate 68. Partition 46 separates coin mechanism 42 from the coin collecting chamber, which is designated 28 (FIG. 4). Partition 46 has a sloping portion 48 extending from side-to-side of upper portion 32 over arrow 44 and downwardly toward return receptacle 30, a chute-like portion 50 extending from front to rear of lower portion 34 under return receptacle 30, and a vertical portion 52 joining sloping portion 48 to chute-like portion 50. Upper portion 32 has a back wall 49 to which sloping portion 48 is secured. Chute-like portion 50 slopes from rear to front to carry coins that fall thereon to the entrance of return receptacle 30 for easy access by the customer. A rectangular opening 54 is formed in sloping portion 48 directly under arrow 44 to permit coins to drop from the deposit point into collecting chamber 28. An upright partition 60 extends between sloping portion 48 and flank panel 37 parallel to back wall 49. Gate 68, which is formed from a flat plate, is attached to sloping portion 48 at the lower edge of opening 54 by a horizontal hinge 70 such that part of gate 68 lies above partition 46 and part thereof lies below partition 46. The portion of plate 68 below partition 46 is slightly smaller in width than opening 54 and the portion thereof above partition 46 is slightly smaller in width than the distance between front panel 33 and upright partition 60. Deflector 57 is secured for example by welding to the uderside of sloping portion 48 at the upper edge of opening 54. Deflector 57 and gate 68 when open, converge to guide coins passing through opening 54 to the center of chamber 28. As a result, coins passing through opening 54 from the deposit point are evenly distributed for storage purposes in chamber 28. The lower ends of deflector 57 and gate 68 when open are sufficiently close to each other to preclude coins from passing in the reverse direction from chamber 28 through opening 54 to the deposit point. As a result, if the newsrack is turned upside down by vandals or pilferage is attempted by inserting a wire into door latch opening 31, the coins in chamber 28 remain secure against such incursion.

Figure 7:
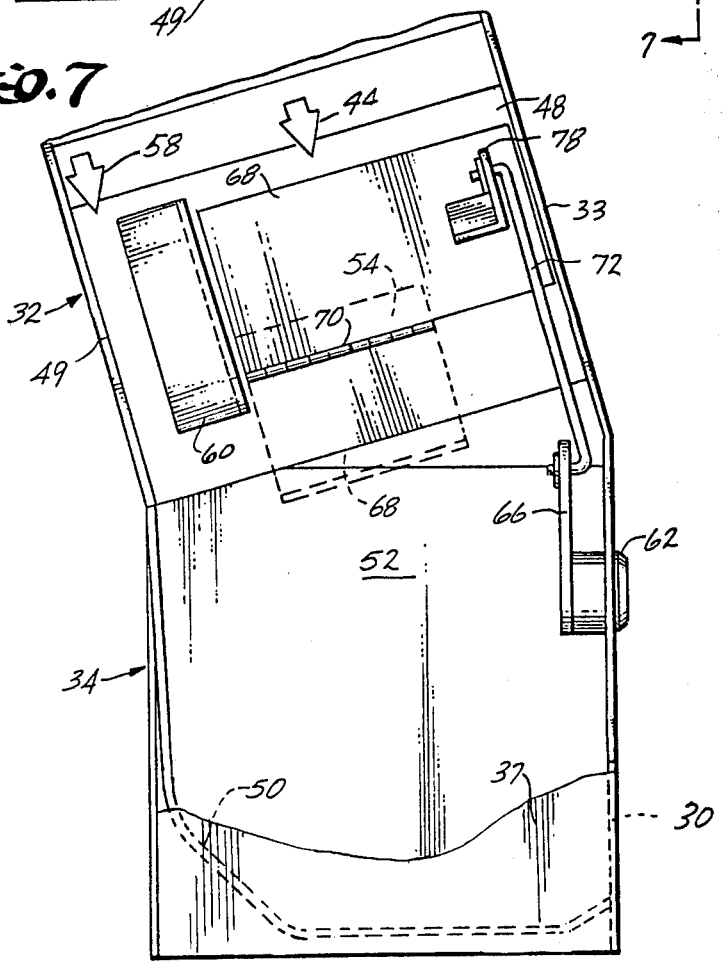
FIG. 7 is a partially cut away left side view of the lower portion of the coin mechanism housing.

As handle 26 is pulled when improper coinage is present in coin mechanism 42, the coins are dropped thereby to a return point rearward of the deposit point in housing 22 as represented by an arrow 58. From the return point, the coins drop onto chute-like portion 50 for delivery to return receptacle 30 (FIG. 7). Partition 60 separates the deposit point and the return point from each other. This insures that the coins to be returned do not find their way into coin collecting chamber 28 and coins to be deposited do not find their way into return receptacle 30.

A key operated cylinder lock 62 is mounted on the front wall of lower portion 34. Lock 62 has a key receiving slot, not shown, exposed to the outside of newsrack 10 and a key driven rotatable shaft 64 extending inside lower portion 34 above return receptacle 30. A crank 66 is secured to shaft 64. A connecting rod 72 extends between the portion of gate 68 above hinge 70 and crank 66. Connecting rod 72 has a hook at the other end secured by a clip 76 to an L-bracket 78, which is fixedly mounted on gate 68. Rod 72 is free to rotate relative to crank 66 and L-bracket 78. Shaft 64 of lock 62 can be rotated between two extreme orthogonal positions represented in FIG. 4.

Normally, during operation of the newsrack, shaft 64, crank 66, gate 68, and connecting rod 72 are in the position represented by hidden lines in FIG. 4. In such case, gate 68 is open, i.e., clear of opening 54 and in fact, helps to guide errant coins into opening 54; coins dropped by coin mechanism 42 to the deposit point are thus transferred through opening 54 to the coin collecting chamber 28 in normal fashion. To load newspapers into newsrack 10, the worker responsible for this job inserts the key into lock 62 and turns shaft 64 into the position in which crank 66, gate 68, and connecting rod 72 are represented by solid lines in FIG. 4. In such case, gate 68 is closed, i.e., covers opening 54, and prevents coins from reaching coin collecting chamber 28; the coins dropped by coin mechanism 42 to the deposit point are thus diverted by gate 68 and sloping portion 48 to return receptacle 30 when the worker inserts the proper coinage in slot 24 and pulls on handle 26 to open door 20. The worker then retrieves the coins from return receptacle 30, loads the newsrack with newspapers, and turns shaft 64 back to open gate 68 once again.

In summary, lock 62 functions as a control device that is movable between a first position and a second position to open and close gate 68. When the control device is in its first position, coins dropped to the deposit point are diverted from opening 54 by closed gate 68 to return receptacle 30. When the control device is in its second position, opening 54 is uncovered by open gate 68 and coins dropped to the deposit point are transferred to coin collecting chamber 28. As a result, the worker can reload any number of newsracks with the same combination of coins, since they are returned after each loading operation.

In the disclosed embodiment of the invention, door 29 to coin collecting chamber 28 is one side of a six-sided, commercial available coin box 80. Box 80 has five closed sides and one open side facing upward to receive coins that dro through opening 54. A key operated lock 82 secures box 80 in coin collecting chamber 28 until lock 82 is opened by an authorized money collecting worker. It should be noted that the back and sides of lower portion 34 together with partition 46 form a "vault" around box 80. Except for opening 54, the only opening in this vault is at the front of lower portion 34 where box 80 is inserted into the vault. When hood 45 is removed from housing 22, coin mechanism 42 is exposed but box 80 is not exposed because of the described vault. The only communication between upper portion 32 and lower portion 34 is through opening 54, which is protected against theft by the described baffle system. Thus, hood 45 may be removed by a maintenance man unauthorized to handle money to service coin mechanism 42 without danger of pilferage.

Figure 11A:
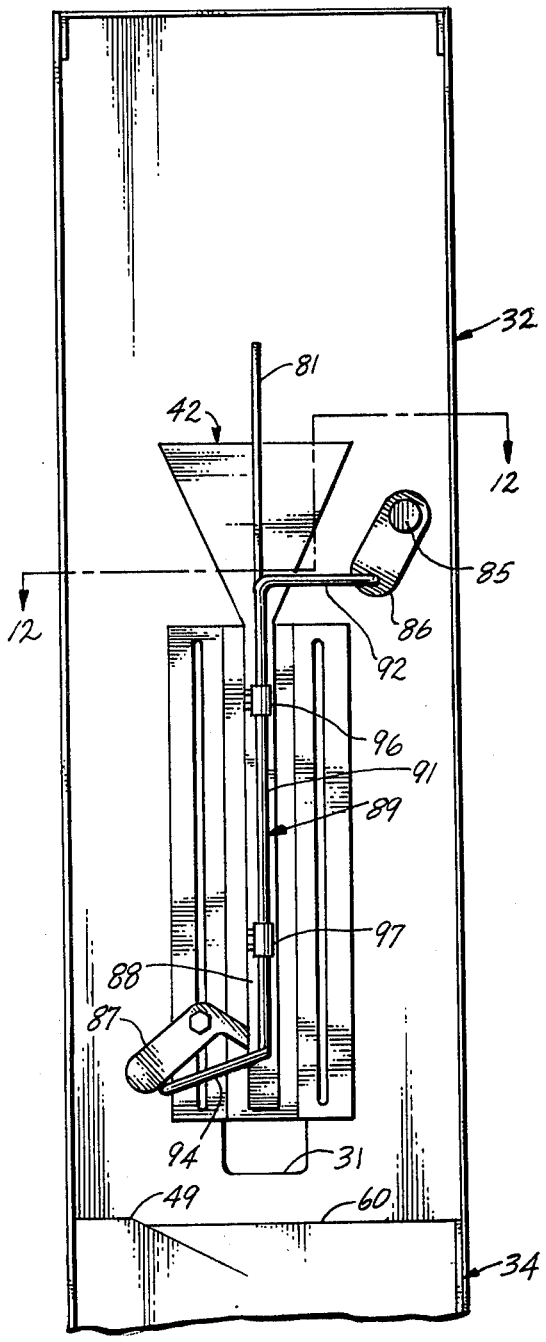
FIGS. 11A and 11B are back views of the housing showing the coin mechanism in the respective coin changeover positions.
Figure 11B:
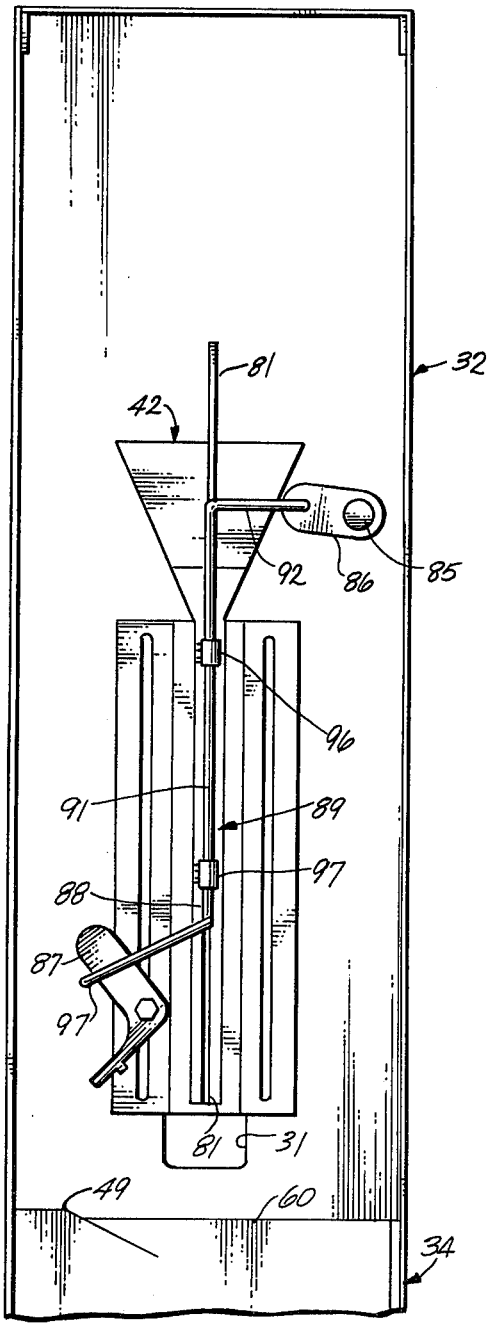
Figure 14:
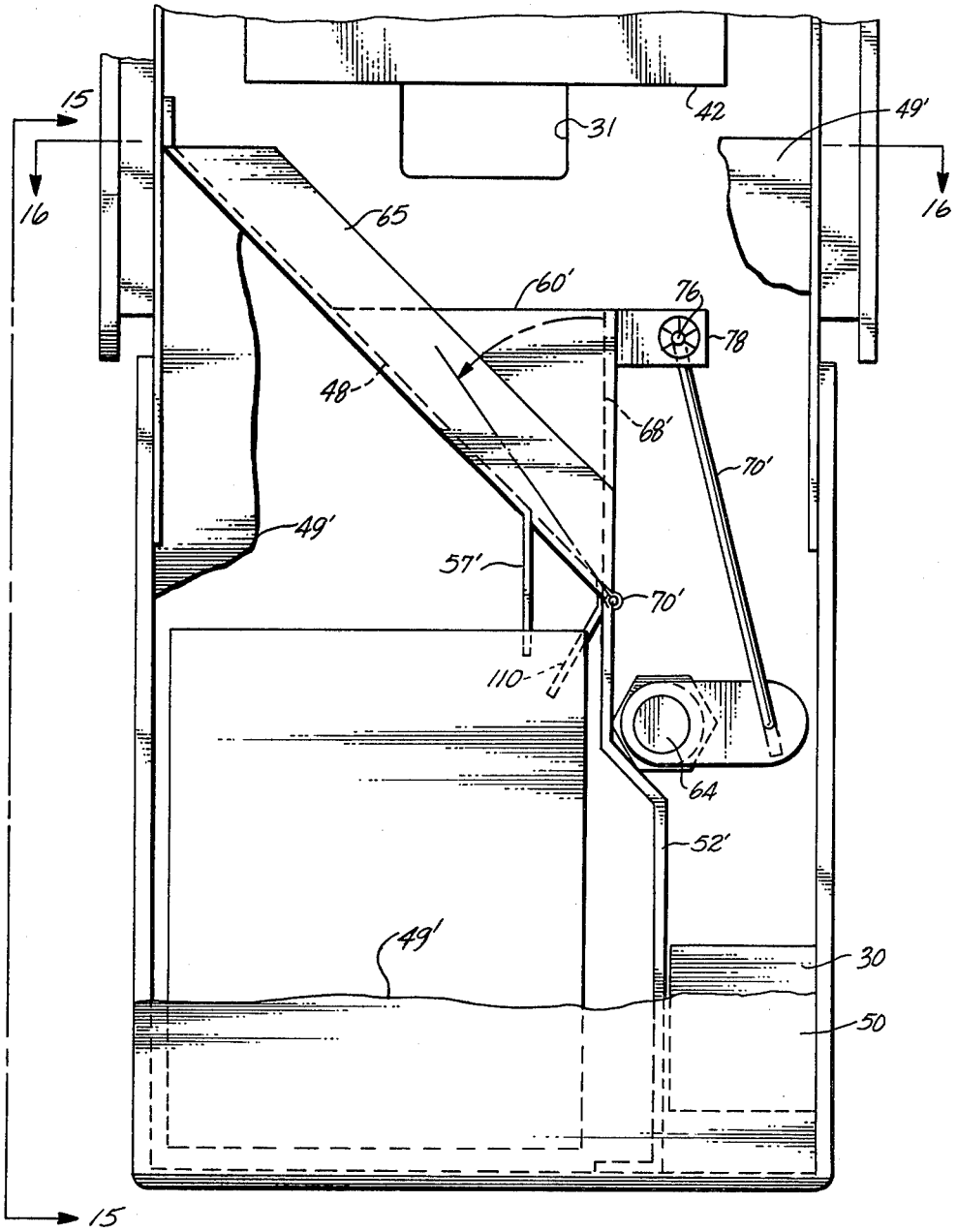
FIG. 14 is a partially cutaway, back view of an alternative embodiment of the lower portion of the coin mechanism housing of the newsrack of FIG. 1 without the hood.
Figure 15:
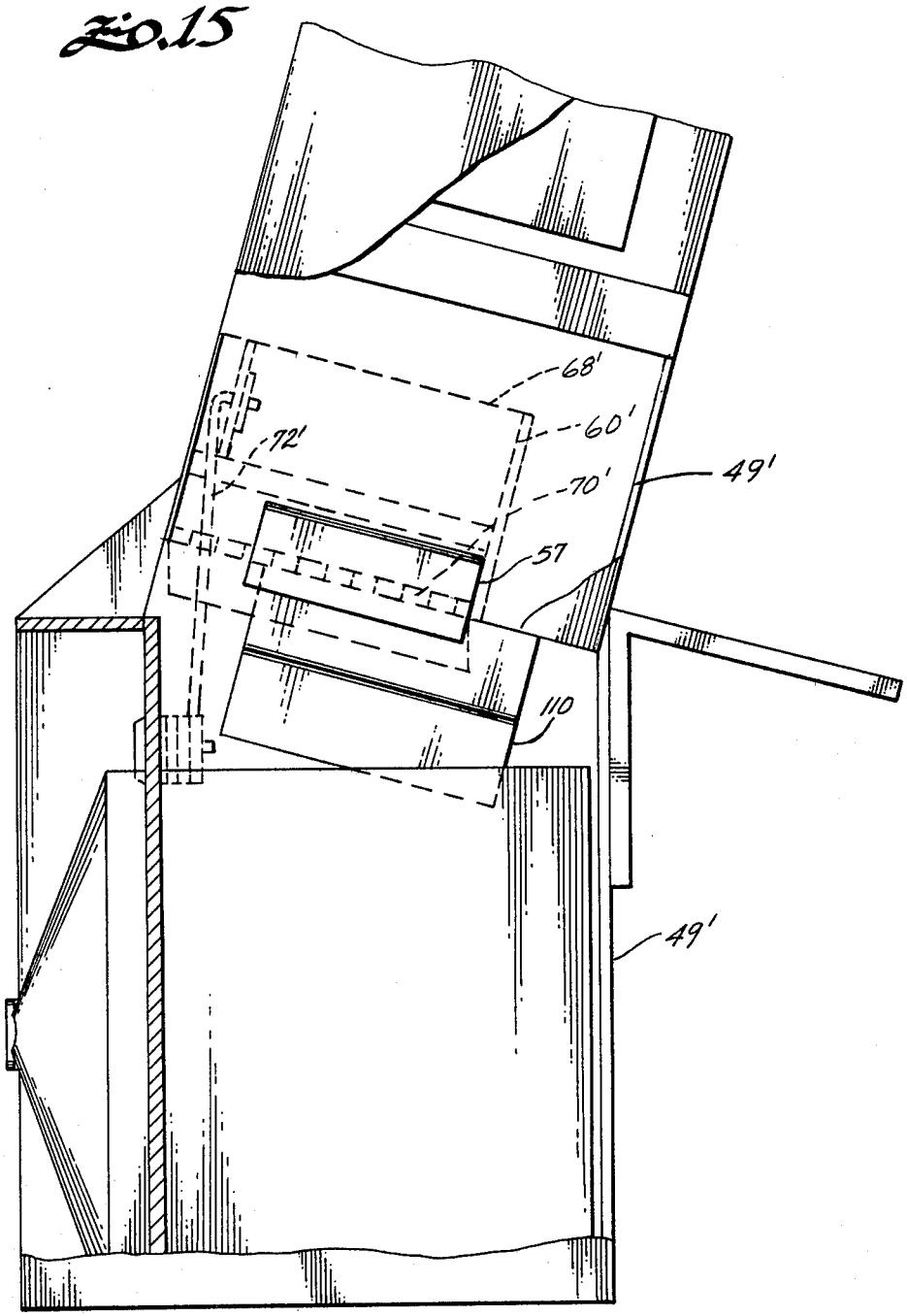
FIG. 15 is a partially cutaway, right side view of the modified embodiment.
Figure 16:
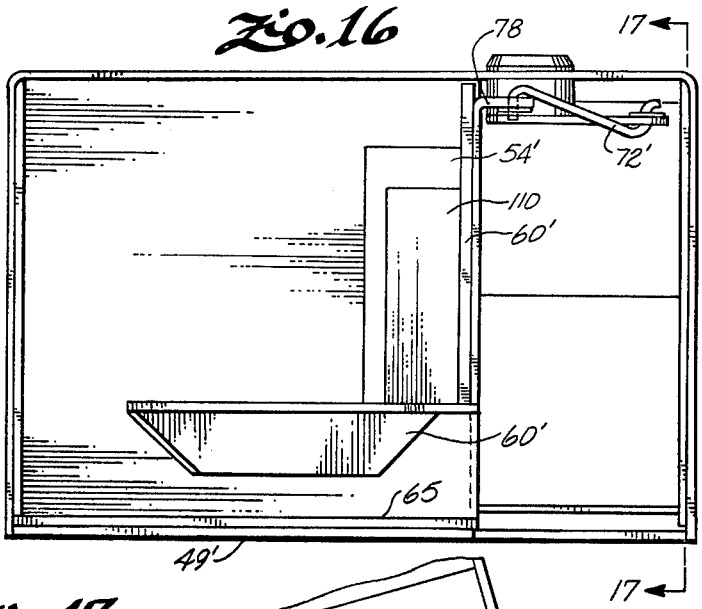
FIG. 16 is a top-sectional view of the modified embodiment taken through the plane designated in FIG. 14.
Figure 17:
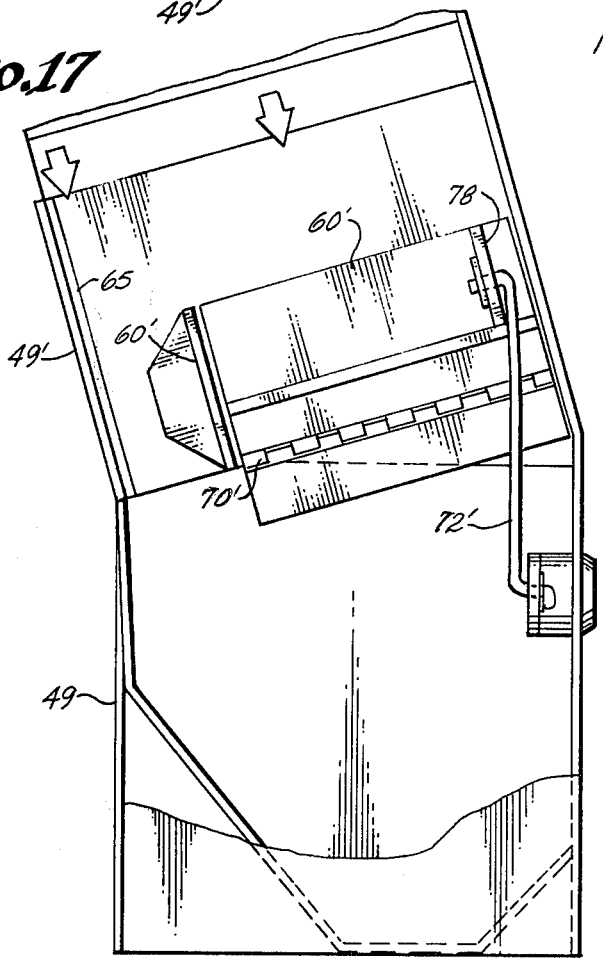
FIG. 17 is a partially cutaway left side view of the modified embodiment.

As described in Chalabian U.S. Pat. Nos. 3,884,330 and 4,049,106, the combination of coins to which a coin mechanism responds can be changed by activating or deactivating one or more pawls normally extending into the coin chute of the coin mechanism. Reference is made to FIGS. 11 through 13 for a description of an improved linkge for coin changeover from one coin combination to another. Selected portions of coin mechanism 42 are illustrated for the the purpose of orientation. A key operated cylinder lock 83 is mounted on front panel 33. Lock 83 has a key receiving slot, not shown, exposed to the outside of the newsrack through an opening 84 in front panel 13 when door 20 is open for loading purposes, and a key driven rotatable shaft 85 extending inside upper portion 32 near the top of coin mechanism 42. A crank 86 is secured to shaft 85. At the bottom of coin mechanism 42 is a pivotal pawl 87 which by reason of its weight distribution normally pivots in a counterclockwise direction as viewed in FIGS. 11A and 11B to extend into a coin chute 88 of coin mechanism 42 as shown in FIG. 11A. An integral linkage 89 couples crank 86 to pawl 87. Linkage 89 comprises a straight rearwardly extending section 90, an upright section 91 transverse to section 90 in nonintersecting relationship therewith, a laterally extending section 92 connecting section 90 with the top of section 91, a forwardly extending section 93 lying under one end of pawl 87, and a slanted laterally extending section 94 connecting portion 93 with the bottom of section 91. Section 90 is connected to crank 86 by a clip 95 so as to be free to rotate and translate relative to crank 86. Section 92 is transverse to sections 90 and 91. Upright section 91 is supported by flexible plastic straps 96 and 97, which are bolted to stationary main wall 81 of coin mechanism 42. Straps 96 and 97 permit upright section 89 to rotate and translate axially.

In one position of lock 83, shown in FIG. 11A, section 93 is spaced below pawl 87. Pawl 87 therefore extends into coin chute 88 to establish one given combination of coins responsive to which coin mechanism 42 permits the newsrack to be opened. In the other position of lock 83, shown in FIG. 11B, section 93 lifts the end of pawl 87, thereby rotating it clockwise out of coin chute 88. This establishes another given coin combination responsive to which coin mechanism 42 permits the newsrack to be opened. As lock 83 rotates between the two described positions, linkage 89 moves up and down to activate and deactivate pawl 87. Because of the eccentricity of the point of connection of section 90 to crank 86 relative to the axis of lock 83, linkage 89 rotates about and translate parallel to the axis of section 91, which is permitted by straps 96 and 97.

FIGS. 13A and 13B illustrate the motion of linkage 89 schematically. A line 98 represents the plane in which crank 86 lies, a line 99 represents the plane parallel to plane 98 in which section 91 lies, a point A represents the end of section 90 at crank 86, a point B represents the end of section 90 at the intersections with section 92, and a point C represents the end of section 92 at the intersection with section 91. In the position of lock 83 shown in FIG. 11A, section 90 is perpendicular to crank 86, i.e., line 98, as represented in FIG. 13A, and section 92 is parallel thereto. As lock 83 rotates to the other position, the point of connection of section 90 to crank 86 moves laterally to the left along line 98. In order to accommodate this lateral movement, point A of section 90 translates somewhat beyond crank 86, i.e., line 98, point B moves somewhat away from line 99, and point C including section 91 rotates as indicated by an arrow 100.

Reference is made to FIGS. 14 through 17 for a modified embodiment of the lower portion of the coin mechanism housing of the newsrack without the hood. Elements that are the same as those in FIGS. 4 through 7 bear the same reference numerals. Elements that perform the same function as elements in FIGS. 4 through 7, but are differently positioned and/or shaped, bear the same reference numerals with a prime, and new elements bear new reference numerals. A gate 68′ is mounted by hinge 70′ on vertical portion 52 where it joins sloping portion 48. An opening 54′ in sloping portion 48 is located adjacent to hinge 70′. Gate 68′ does not extend below opening 54′; instead, a deflector 110 is mounted on vertical portion 52′ so as to deflect coins into coin box 80. Deflector 57′ is formed at the edge of opening 54′ opposite deflector 110. Back wall 49′ covers the back of part of upper portion 32 and all of lower portion 34. The edge of sloping portion 48 is bent into a vertical plane to form a rail 65 to which back wall 49′ is welded. Instead of a partition (60), a triangular-shaped upright wall 60′ is attached to sloping portion 48. Wall 60′ and rail 65 together form a chute on which coins released from the coin chute of the coin mechanism are directed to return receptacle 30.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention.

What is claimed is:

1. A coin operated newsrack comprising:
a support frame;
a newspaper storage compartment on the frame having a normally locked door for access to the compartment;
a coin mechanism housing on the frame;
a coin return receptacle in the housing;
a coin mechanism mounted in the housing and adapted to unlock the door of the compartment, and drop coins at a designated deposit point in the housing responsive to actuating means when the proper coinage is present, and adapted to drop coins in the coin return receptacle responsive to the actuating means when the proper coinage is not present;
a coin collecting chamber in the housing underneath the deposit point;
a passageway between the deposit point and the coin collecting chamber to permit coins to drop from the coin mechanism to the coin collecting chamber;
a control device movable between a first position and a second position; and
means responsive to the control device for diverting coins at the deposit point from the passageway to the return receptacle when the control device is in its first position and for clearing the opening to transfer coins from the deposit point to the coin collecting chamber when the control device is in its second position.

2. The newsrack of claim 1, in which the coin transfer path comprises a partition in the housing between the coin mechanism and the coin collecting chamber, the partition sloping downwardly from the return and deposit points toward and emptying into the receptacle, the passage comprising an opening in the partition at the deposit point, and the diverting means comprising a plate coinciding in width with the opening and means for pivotably attaching the plate to the edge of the opening so the plate is pivotable between a position in which the opening is closed and a position in which the opening is open.

3. The newsrack of claim 2, in which the plate is pivoted so it slopes approximately in the same direction as the partition when the opening is closed and slopes approximately in a direction opposite to the partition when the gate is open.

4. The newsrack of claim 3, in which the control device comprises a cylinder lock having a key slot and a key driven rotatable shaft, the lock being mounted in the housing with the key receiving slot exposed to the outside thereof and the shaft extending inside thereof, and a mechanical linkage connected between the shaft and the plate.

5. A coin operated newsrack comprising:
a support frame;
a newspaper storage compartment on the frame having a normally locked door for access to the compartment;
a coin mechanism housing on the frame;
a coin mechanism mounted in the housing and adapted to unlock the door of the compartment and drop coins at a designated deposit point in the housing responsive to actuating means when the proper coinage is present;
a coin collecting chamber in the housing underneath a deposit point;
a partition in the housing separating the coin collecting chamber from the coin mechanism;
an opening in the partition in the vicinity of the deposit point to permit coins to drop from the coin mechanism to the coin collecting chamber;
a coin return receptacle in the housing on the same side of the partition as the coin mechanism;
the coin mechanism being adapted to drop coins at a designated return point in the housing lying above the partition and the receptacle responsive to actuating means when the proper coinage is not present;
the partition sloping downwardly from the return point to the receptacle to provide a coin transfer path therebetween; and
the housing having a removable cover exposing the coin mechanism without exposing the coin collecting chamber.

6. The newsrack of claim 5, in which the coin collecting chamber has a lockable door on the side of the housing opposite the removable cover.

7. The newsrack of claim 6, in which the door of the coin collection chamber comprises a six-sided box, five closed sides and on open side, the box fitting in the coin collecting chamber with an open side facing upward, and the housing with the partition forms a vault around the box except for an opening for insertion of the box in the housing.

8. The newsrack of claim 5, additionally comprising means for diverting coins from the deposit point away from the opening in the partition to the receptacle.

9. The newsrack of claim 8, in which the diverting means comprises:

a gate movable between a first position in which it covers the opening to divert coins from the deposit point to the receptacle and a second position in which it uncovers the opening to divert coins from the deposit point to the coin collecting chamber;

a cylinder lock mounted in the housing with a key slot lying outside the housing and a key actuated rotatable shaft lying inside the housing; and a mechanical linkage connecting the shaft to the gate to move the gate between the first and second positions as the shaft rotates.

10. A coin operated newsrack comprising:

a support frame;

a newspaper storage compartment on the frame having a normally locked door for access to the compartment;

a coin mechanism housing on the frame;

a coin mechanism mounted in the housing and adapted to unlock the door of the compartment, and drop coins at a designated deposit point in the housing responsive to actuating means when the proper coinage is present;

a coin collecting chamber in the housing underneath the deposit point;

a partition in the housing separating the coin collecting chamber from the coin mechanism;

an opening in the partition in the vicinity of the deposit point to permit coins to pass from the coin mechanism to the coin collecting chamber;

a first flat baffle attached to the partition adjacent to one side of the opening in the partition and extending downwardly from the partition to deflect toward the other side of the opening coins dropping to the chamber; and a second flat baffle attached to the partition adjacent to the other side of the opening in the partition and extending downwardly from the partition toward the first baffle such that the baffles converge toward approximately the middle of the chamber to permit passage of coins from the deposit point to the chamber and inhibit reverse passage of coins.

11. The newsrack of claim 10, additionally comprising a coin return receptacle in the housing, the partition sloping toward the coin return receptacle, a control device movable beten a first position and a second position, the first baffle being pivotally attached to the partition and extending through the opening above the partition, and means responsive to the control device for pivoting the first baffle to cover the opening when the control device is in its first position so coins dropped at the designated deposit point slide across the partition to the return receptacle and for pivoting the first baffle to uncover the opening when the control device is in its second position so coins dropped at the designated deposit point pass through the opening to the coin collecting chamber.

12. The newsrack of claim 11, in which the coin mechanism is adapted to drop coins at a designated return point responsive to the actuating means when the proper coinage is not present, so coins dropped at the designated return point slide across the partition to the coin return receptacle, the newsrack additionally comprising a dividing wall extending across the partition transverse to the baffles to separate the designated deposit and return points, the dividing wall defining with the partition and the first baffle a funnel-like passage from the designated coin deposit point to the opening in the partition.

13. A newsrack comprising:

a support frame having a substantially flat top panel;

a newspaper storage compartment on the frame having a normally locked door for access to the compartment;

a coin mechanism housing having a plurality of substantially closed sides, a closed top, a closed bottom, and an open side between at least part of the top and bottom and between two of the substantially closed sides;

means for mounting the housing on the frame under the top panel to form between the top panel and the closed top of the housing a hood receiving region having an entrance;

a coin mechanism mounted in the housing and adapted to unlock the door of the compartment when the proper coinage is present;

a hood for the housing having a plurality of substantially closed sides, an open top, an open bottom, and an open side between the top and bottom and between two of the substantially closed sides;

means for forming a restriction at the entrance of the region between the top panel and the housing to permit passage of the top of the hood into the region only when acutely angled relative to the housing;

the hood fitting the housing in parallel abutting relationship with the top of the hood occupying the region when in place such that the substantially closed sides of the hood cover the open side of the housing; and means for securing the hood in place.

14. The newsrack of claim 13, in which the securing means comprises a first bracket mounted on one closed side of the hood, the first bracket having a first flange extending transversely from the bottom edge of the hood and a first locking hole in the flange, and a second bracket mounted on the housing, the second bracket having a second flange extending transversely from the housing under the first flange in adjacent relationship therewith when the hood is in place and a second hole through the second flange aligned with the first hole when the hood is in place, the second flange serving to support the hood in the parallel abutting relationship.

15. The newsrack of claim 13, in which the means for forming a restriction comprises a bar attached to the frame and extending downwardly and transversely to the top panel thereof to partially cover the entrance to the region between the housing and the top panel.

16. The newsrack of claim 13, in which the top of the housing is perpendicular to the closed sides thereof, the frame has a front panel forming a given obtuse angle with the top panel, the housing is mounted on the front panel such that the top of the housing angles away from the top panel moving away from the front panel, and the top of the hood forms an obtuse angle with the open side thereof approximately the same as the given obtuse angle such that the top of the hood lies in closely spaced approximately parallel relationship to the top panel when the hood is in place.

17. A coin mechanism enclosure comprising:

a housing having a hexahedral upper portion with an open back, a closed front, closed flanks, and a closed top defining a coin mechanism receiving region and an integral bottom portion completely enclosed except for a coin box receiving cavity and a passage from the coin mechanism receiving region to the cavity; a hexahedral hood having an open front, a closed back, closed flanks, an open top and an open bottom adapted to cover the open back and the closed flanks of the first portion, the bottom of the hood being approximately perpendicular to its front and the top of the hood being at an obtuse angle to its front sides; and a first bracket mounted on the back of the hood, the first bracket having a first flange extending transversely from the bottom edge of the hood and a first locking hole in the flange, and a second bracket mounted on the housing, the second bracket having a second flange extending transversely from the back of the housing under the first flange in adjacent relationship therewith when the hood is in place, and a second hole through the second flange aligned with the first hole when the hood is in place, the second flange serving to support the hood in the parallel abutting relationship.

18. The coin mechanism enclosure of claim 17, in which the bottom portion has closed flanks thicker than the closed flanks of the upper portion to form at the boundary of the upper and lower portions shoulders serving to guide and support the bottom edges of the flanks of the hood from the acutely angled to the parallel abutting relationship.

19. The coin mechanism enclosure of claim 18, in which the bottom portion of the housing is approximately hexahedral and the upper portion of the housing angles away from the bottom portion thereof such that the back of the top portion is at the obtuse angle to the back of the bottom portion and the shoulders are approximately perpendicular to the front of the top portion.

20. A coin operated newsrack comprising:

a support frame;

a newspaper storage compartment on the frame having a normally locked door for access to the compartment;

a coin mechanism housing mounted on the frame;

a coin mechanism mounted in the housing and adapted to unlock the door of the compartment when the proper coinage is present;

a shaft mounted for rotation on the housing;

a crank mounted on the shaft inside the housing;

an integral linkage having a first section, a second section transverse to the first section in non-intersecting relationship therewith, and a third section connecting the first and second sections and being approximately transverse thereto;

means for supporting the second section with freedom of axial and rotational movement;

a connection between the crank and one end of the first section providing rotational and axial translational freedom of movement for the first section; and means responsive to axial movement of the second section for changing the proper coinage of the coin mechanism.

21. The newsrack of claim 20, in which the shaft is part of a cylinder lock mounted on the housing having a key slot external of the frame and the crank comprises a pivot arm attached to the shaft to extend transversely therefrom.

* * * * *